United States Patent [19]

Weisbach

[11] 4,184,673

[45] Jan. 22, 1980

[54] METHOD OF AND AN APPARATUS FOR ALIGNING SHEETS ADVANCING IN AN OVERLAPPING ARRAY TO A PRINTING MACHINE

[75] Inventor: Günter Weisbach, Radebeul, German Democratic Rep.

[73] Assignee: VEB Polygraph Leipzig Kombinat für Polygraphische Maschinen und Ausrüstungen, Leipzig, German Democratic Rep.

[21] Appl. No.: 793,952

[22] Filed: May 5, 1977

Related U.S. Application Data

[63] Continuation-in-part of Ser. No. 788,774, Apr. 19, 1977, abandoned.

[30] Foreign Application Priority Data

Apr. 19, 1976 [DD] German Democratic Rep. ... 192412
Feb. 21, 1977 [DD] German Democratic Rep. ... 197455

[51] Int. Cl.[2] ..... B65H 9/00
[52] U.S. Cl. ..... 271/237; 271/251
[58] Field of Search ..... 271/236, 237, 229, 230, 271/250, 251, 252

[56] References Cited

U.S. PATENT DOCUMENTS

| | | | |
|---|---|---|---|
| 2,182,023 | 12/1939 | Harrold | 271/237 |
| 2,937,020 | 5/1960 | Layden | 271/237 |
| 2,984,483 | 5/1961 | Kist | 271/237 |
| 4,060,237 | 11/1977 | Degen et al. | 271/237 |

*Primary Examiner*—Richard A. Schacher
*Attorney, Agent, or Firm*—Michael J. Striker

[57] ABSTRACT

An elongated array of partially overlapping sheets advances to a printing machine and, prior to entering the same the individual sheets of the array, one after another, are aligned both along their front edges and along one of their lateral edges. This is accomplished by first displacing the respective sheet transversely of the array so that a lateral marginal portion adjacent to the one lateral edge becomes exposed, after or during alignment along the front edge, and by subsequently engaging the exposed lateral marginal portion of the respective sheet and displacing the latter a further distance only transversely of the array into a position in which the one lateral edge is aligned. Subsequently to the alignment along both of the above-mentioned edges, the respective sheet may be partially returned by a given distance prior or during feeding of the sheet into the printing machine. The apparatus includes a suction belt conveyor which displaces the respective sheet the first distance, and an engaging device which displaces the sheet the second distance, while the return of the sheet may be accomplished by an in-feed gripper of the printing machine. The engaging device may include a suction rail reciprocating transversely of the array, or a roller mechanically cooperating with a gripping rail to engage the exposed lateral marginal portion of the sheet and to displace the latter by the second distance.

23 Claims, 10 Drawing Figures

FIG. 7
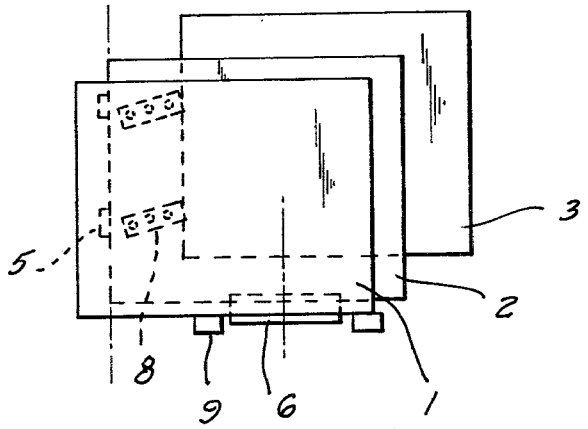
FIG. 8
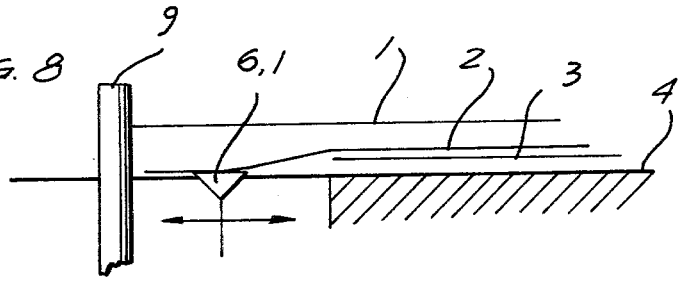
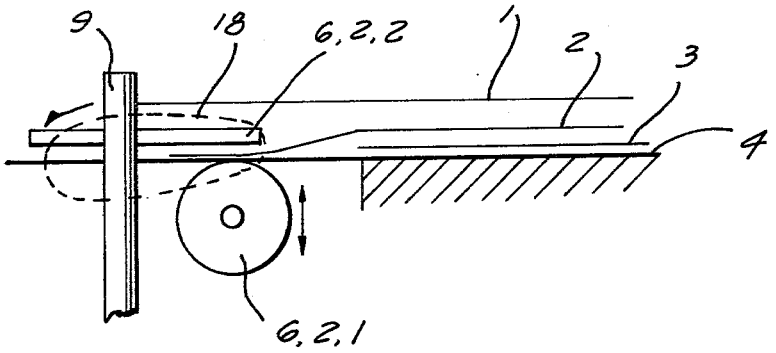
FIG. 9

METHOD OF AND AN APPARATUS FOR ALIGNING SHEETS ADVANCING IN AN OVERLAPPING ARRAY TO A PRINTING MACHINE

CROSS-REFERENCE TO RELATED APPLICATION

The present application is a continuation-in-part of my previous copending application Ser. No. 788,774, filed on Apr. 19, 1977, meanwhile abandoned.

BACKGROUND OF THE INVENTION

The present invention relates to a method of and an apparatus for aligning sheets advancing in an overlapping array in general, and more particularly to such a method and apparatus which are used for feeding properly aligned sheets of the above-mentioned array to a printing machine.

There are already known various arrangements for feeding sheet material to be printed to a printing machine, among them such which are operative for feeding individual sheets, previously arranged in a stack, to the printing machine. While it has been proposed to individually lift the respective sheets from the stack and individually convey them to the printing machine, experience has shown that the speed of operation of the printing machine can be dramatically increased when, rather than separately conveying the individual sheets, such sheets are advanced to the printing machine in the form of an array of such sheets in which each succeeding sheet partially overlaps the preceding sheet. When this approach is resorted to, however, it has been found that many problems arise, particularly those connected with proper engagement of the individual sheets by devices which align each individual sheet of the succession of sheets along its lateral edge. However, a proper alignment of each individual sheet both along its front edge and along its lateral edge is a necessary precondition for the proper performance of the printing function by the printing machine. Thus, the problems which have been encountered previously in connection with reliably aligning individual sheets along the lateral edges have so far hampered the full-scale introduction of this expedient in the printing industry.

In an attempt to eliminate these problems, it has already been proposed to utilize a suction rail or a special arrangement at the in-feed gripper of the printing machine which laterally or transversely displaces the individual sheet relative to the array either prior to or during its introduction into the printing machine. This transverse displacement of the individual sheet relative to the array of such sheets exposes the lateral edge of the individual sheet to be aligned for the alignment of the individual sheet along its exposed lateral edge.

However, experience has shown that even this attempted solution to the existing problem is disadvantageous in some respects, particularly in view of the fact that the lateral displacement and alignment must be finished by the time when the immediately succeeding sheet, and actually the front edge thereof, reaches the operating range of the pulling device which displaces the individual sheets in the lateral direction. As a result of this, only so much time is available for the alignment of the individual sheet by the front stops and by the lateral guides as there is between the arrival of the individual sheets to be aligned to the front stops and the arrival of the next-succeeding sheet of the array into the operating range of the lateral displacing device. Such a time period is extremely short, particularly at high feeding speeds, so that a reliable alignment of the individual sheets cannot be always accomplished, especially for some sorts of paper sheets or the like.

SUMMARY OF THE INVENTION

Accordingly, it is a general object of the present invention to avoid the disadvantages of the prior art.

More particularly, it is an object of the present invention to propose a method of aligning individual sheets of an elongated array of such sheets which partially overlap one another, which is not possessed of the above-enumerated disadvantages of the prior-art methods.

It is a further object of the present invention to present a method of aligning the individual sheets of the array in which the sheet which is being instantaneously aligned can be aligned without interference with or by the next-preceding and/or the next-succeeding sheet.

Still another object of the present invention is to devise a method of aligning sheets which assures proper alignment of the individual sheets prior to their feeding into the printing machine, under all circumstances.

A concomitant object of the present invention is to design an apparatus capable of accomplishing the above method in a simple, reliable and inexpensive manner.

Yet another object of the present invention is to so construct the apparatus for aligning the individual sheets of the array that it is capable of aligning the sheets without interference with the other sheets of the array.

Finally, it is an object of the present invention to provide the above-mentioned apparatus which is simple in construction, reliable in operation, and inexpensive to manufacture.

In pursuance of these objects and others which will become apparent hereafter, one feature of the present invention resides, briefly stated, in a method of aligning individual sheets of an elongated array of such sheets which advances longitudinally thereof to a printing machine and in which each succeeding sheet partially overlaps the preceding sheet, which comprises the steps of displacing a respective sheet of the array substantially in a plane of the latter by a distance having at least a component in a direction transverse to the elongation of the array to thereby expose a lateral marginal portion of the respective sheet; aligning the respective sheet at a front edge thereof; engaging the exposed lateral marginal portion of the frontwardly aligned sheet and applying thereto a force which displaces the frontwardly aligned sheet substantially in the plane by a further distance only in said direction into an aligned position of a lateral edge delimiting the exposed marginal portion of the respective sheet; and releasing the frontwardly and laterally aligned sheet for further advancement to the printing machine.

The method of the present invention may further comprise the step of moving the frontwardly and laterally aligned sheet subsequently to said releasing step opposite to said direction and substantially in said plane by a given distance, either prior to or during the feeding of the aligned sheet into the printing machine. Alternatively, the method of the present invention may comprise the step of advancing the frontwardly and laterally aligned sheet subsequently to said releasing step to the printing machine in a path in which the lateral edge of the exposed lateral marginal portion of the respective sheet travels in an extension of the aligned position thereof.

The displacing step may be performed at least partially prior to the aligning step, or it can be performed entirely subsequently to the aligning step. When the displacing step is performed prior to the aligning step, the method may include the step of pre-aligning the respective sheet prior to the displacing step.

The method of the present invention which includes the above-enumerated steps renders it possible to expose the entire lateral marginal portion of the respective individual sheet which is to be then laterally aligned, and thus renders it possible to align the sheet without interference with or inference by the next-following sheet with the aligning operation.

As a result of the exposure of the entire lateral marginal portion of the individual sheet to be aligned, the point or line or area of application of the above-mentioned force can be located at any desired location relative to the individual sheet being aligned, that is, it can be located at any desired distance from the front alignment line, so that the line of application of the above-mentioned force can extend through the central point of the major surface of the respective sheet. On the other hand, when heavy sheet material, such as heavy paper or cardboard, is to be aligned, the force applied to the respective individual sheet being aligned can be distributed among two or more locations. Additionally, the method of the invention renders it possible to align even stiff or inflexible materials.

According to a further facet of the present invention there is provided an apparatus for aligning individual sheets of an elongated array of such sheets which advances longitudinally thereof over an in-feed table to a printing machine and in which each succeeding sheet partially overlaps the preceding sheet, which comprises means for displacing a respective sheet of the array substantially in a plane of the latter by a distance having at least a component in a direction transverse to the elongation of the array to thereby expose a lateral marginal portion of the respective sheet; means for aligning the respective sheet at the front edge thereof; means for engaging the exposed marginal portion of the frontwardly aligned sheet and for applying thereto a force which displaces the frontwardly aligned sheet substantially in said plane by a further distance only in said direction into an aligned position of a lateral edge delimiting the exposed lateral marginal portion of the respective sheet; and means for releasing the frontwardly and laterally aligned sheet for further advancement to the printing machine.

In a currently preferred embodiment of the present invention, the displacing means includes at least one belt arranged underneath the in-feed table and having an outer surface adapted to contact a lower major surface of the respective sheet, and means for moving the belt. The belt may include a plurality of perforations, and the displacing means may further include means for applying a partial vacuum to the interface between the outer surface of the belt and the lower major surface of the respective sheet through such perforations.

The apparatus may further comprise separately adjustable brushes which contact an upper major surface of the respective sheet in the rear region thereof which assure the abutment of the respective sheet against the front stops for aligning the sheet along its front edge.

The belt may extend at an angle to the elongation of the array of sheets. Under these circumstances, the belt may include at least one intercepting projection, preferably of a hook-shaped configuration, which extends outwardly beyond the outer surface of the belt and constitutes an abutment for the front edge of the respective sheet for pre-aligning the same prior to the abutment of the front edge against the front stops. However, it is also proposed by the present invention to so arrange the belt that it extends in the transverse direction of the array.

As mentioned above, the aligning means may include front stops. The apparatus may also comprise at least two lateral guides against which the lateral edge of the exposed lateral marginal portion of the respective sheet abuts in the above-mentioned aligned position thereof.

In an advantageous embodiment of the apparatus of the present invention, the engaging means includes a pulling device which is arranged laterally of the in-feed table as considered in the above-mentioned direction. Such pulling device may include a pneumatic suction rail, and means for reciprocating such rail in and opposite to the above-mentioned direction. On the other hand, the pulling device may include a roller and a pulling rail which mechanically cooperate with one another to pull the respective sheet in the above-mentioned direction.

According to a further concept of the present invention, the apparatus may comprise means for moving the frontwardly and laterally aligned sheet upon the release thereof opposite to the above-mentioned direction and substantially in said plane by a given distance. The moving means may be arranged at the in-feed gripper of the printing machine. As an alternative, the apparatus may comprise means for advancing the frontwardly and laterally aligned sheet upon the release thereof to the infeed gripper of the printing machine in a path in which the lateral edge of the exposed lateral marginal portion of the respective sheet travels in an extension of the aligned position thereof.

When the apparatus of the present invention operates according to the latter principle, there is obtained the advantage that the aligned sheet can be fed into the printing machine without being displaced laterally opposite to the original transverse direction after the completion of the aligning operation. As a result of this, the construction of the in-feed gripper of the printing machine is rather simple, or other otherwise necessary means for laterally displacing the aligned sheet can be dispensed with.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 7 is a view similar to FIG. 3 but of a further modification;

FIG. 8 is a side elevational view of a pneumatic pulling rail used in the apparatus of the present invention; and FIG. 9 is a side elevational view of a mechanical pulling device used in the apparatus of the present invention.

DESCRIPTION OF THE PREFERRED EMBODIMENTS

Figure 1:
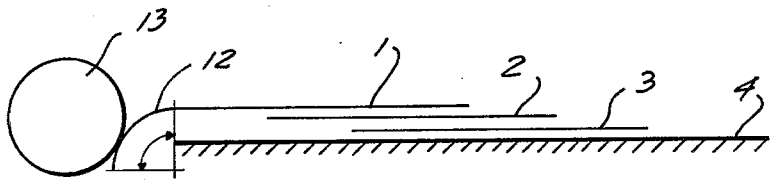
FIG. 1 is a somewhat diagrammatic side elevational view of the apparatus of the present invention illustrating an array of partially overlapping individual sheets.

Referring now to the drawing in detail, and first to FIG. 1 thereof, it may be seen that it illustrates an array of mutually overlapping sheets 1, 2, 3 advancing along an in-feed table 4 of a printing machine toward an in-feed gripper 12 and an in-feed roller 13 of the printing machine. In this connection, it is to be mentioned that the way the array of overlapping sheets 1, 2, 3 is formed and advanced along the in-feed table 4, as well as the construction and operation of the in-feed gripper 12 and in-feed roller 13 of the printing machine, are entirely conventional and not part of the present invention so that they need not be discussed here.

The construction and operation of the apparatus of the present invention will become apparent from the various Figures of the drawing which illustrate the various phases of the displacement of the respective sheet being aligned in several modifications of the basic concept of the present invention.

Figure 2A:
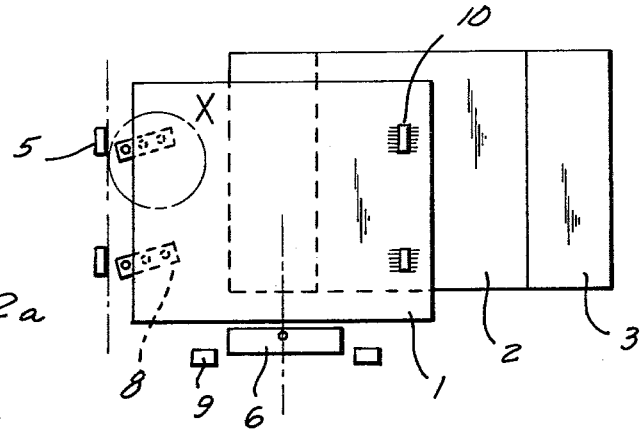
FIG. 2*a* is a schematic top-plan view of FIG. 1 illustrating a first phase of lateral displacement of the respective sheet.
Figure 2B:
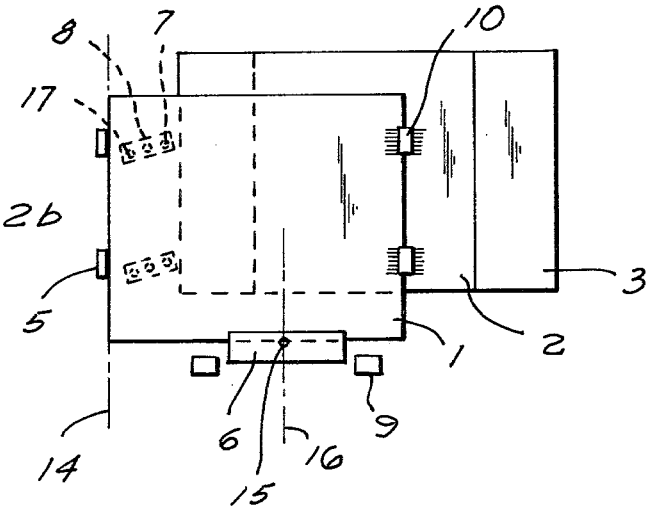
FIG. 2*b* is a view similar to FIG. 2*a* but illustrating the second phase of the lateral displacement.

Turning first to FIGS. 2*a* to 5, it may be seen that FIG. 2*a* illustrates the situation where the sheet 1 of the array has already been displaced from its original position in the array in a direction which has a component in the transverse direction of the array. The remaining sheets 2, 3 still assume their original positions in the array. On the other hand, FIG. 2*b* illustrates the situation where the lateral displacement of the sheet 1 into the position in which the lateral marginal region of the sheet 1 is exposed has already come to an end. In this position, the sheet 1 abuts against front stops 5 which align the sheet 1 along its front edge. On the other hand, the exposed lateral marginal region of the sheet 1 is located in the operating range of an engaging or pulling device 6. However, the following sheets 2 and 3 are still in their original positions relative to the array.

Figure 3:
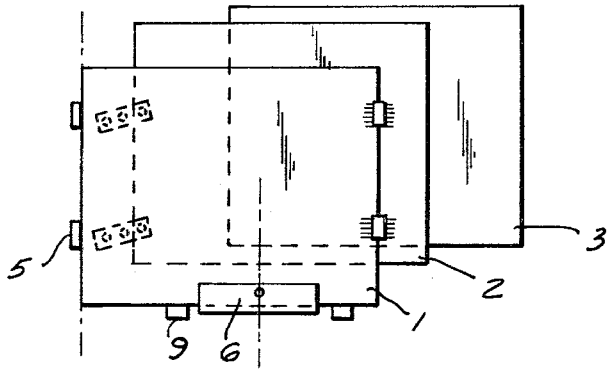
FIG. 3 is a view similar to FIGS. 2*a* and 2*b* but illustrating lateral alignment.

FIG. 3 illustrates a further phase of the aligning operation in which the sheet 1 is in alignment not only with the front stops 5, but also with lateral guides 9 so that the sheet 1 is aligned both frontwardly and laterally. On the other hand, the next-following sheet 2 is already partially displaced transversely of the array and thus the lateral marginal region thereof is already partially exposed. Thus, the lateral displacement into the position in which the lateral marginal portion of the following sheet is being exposed and the alignment of the preceding sheet along its lateral edge are conducted partially simultaneously with one another.

Figure 4:
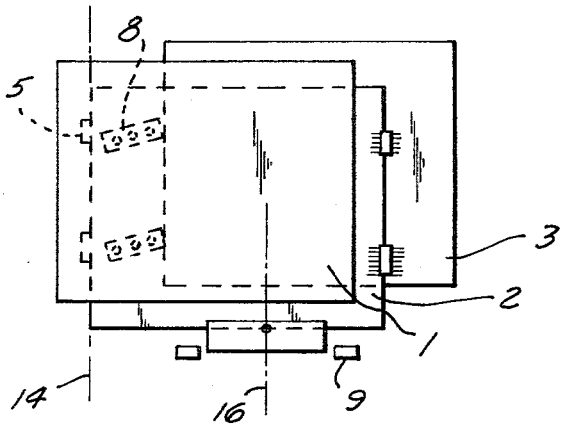
FIG. 4 is a view similar to FIGS. 2*a* to 3 but illustrating partial return of the respective sheet following the alignment thereof.

Finally, FIG. 4 illustrates the situation in which the sheet 1 is released, in a conventional manner, for further travel toward the printing machine. Prior to, or simultaneously with, the feeding of the sheet 1 into the printing machine, the aligned sheet 1 is displaced, in a conventional non-illustrated manner, transversely of the array and oppositely to its displacement during the exposure of its lateral marginal portion and the subsequent lateral alignment.

In the modification illustrated in FIG. 4, the transverse displacement of the sheet 1 to be laterally aligned takes place only at the arrival of the sheet 1 too, and abutment of the front edge thereof against the front stops 5. The other operating steps are performed in a manner similar to that discussed above in connection with FIGS. 3 and 4.

Having so discussed the various phases of operation of the apparatus of the present invention, the various components which together constitute the apparatus of the present invention will now be described.

First of all, the apparatus of the present invention, in the modification illustrated in FIGS. 2*a* to 4, includes a suction belt 8 having a plurality of perforations 17, which belt 8 is arranged within or underneath the in-feed table 4 and has an outer surface with which the lower surface of the respective sheet comes into contact. The suction belt 8 of this modification extends at an angle to the direction of advancement of the array of the individual sheets.

As already mentioned previously, the apparatus of the invention further includes front stops 5, lateral guides 9, and a pulling or engaging device 6. Furthermore, separately driven and adjustable brushes or brush rollers 10 are further arranged at the in-feed table 4, the brushes 10 being located at the region of the respective rear zone of the respective sheet to be or being aligned.

The reference numeral 14 refers to a front alignment line, while the reference numeral 16 indicates a line along which the sheet is being pulled by the pulling device 6. The lines 14 and 16 are of only theoretical significance, the former indicating the line of application of the front stops 5 to the front edge of the respective sheet, and the latter passing through a point 15 of application of the force exerted by the pulling device 6 on the respective sheet.

Figure 6:
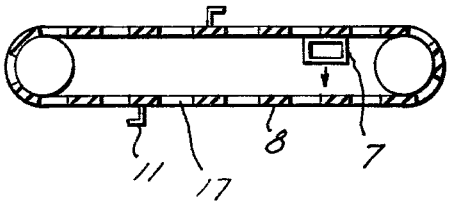
FIG. 6 is a side elevational view of a detail X of FIG. 2*a*, at an enlarged scale, illustrating a suction belt.

Referring now to FIG. 6, it may be seen that it illustrates the suction belt 8 as having intercepting hooks 11 which advance together with the suction belt 8. The intercepting projections 11 serve to intercept the front edge of the respective sheet prior to reaching the front stops 5. In the space bounded by the suction belt 8, there is arranged a suction box 7 with which non-illustrated conventional vacuum source communicates.

Figure 5:
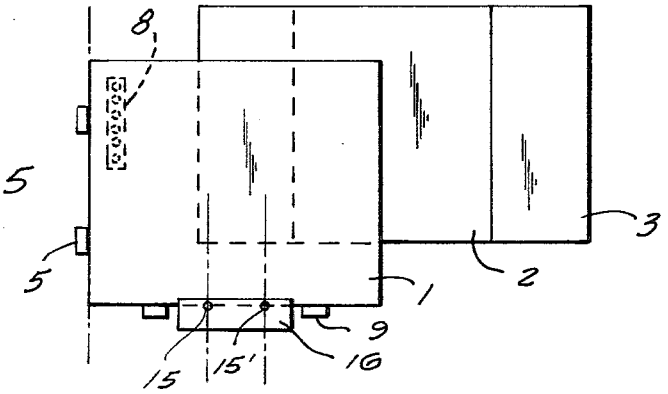
FIG. 5 is a view similar to FIG. 3 but of a modification of the apparatus of the present invention.

In the arrangement illustrated in FIG. 5, the suction belt 8 extends transversely of the direction of advancement of the array of sheets. In this arrangement, the suction belt 8 is not provided with any intercepting projections 11.

The drawing does not illustrate any arrangements for a lateral return displacement of the aligned sheet 1 opposite to its prior displacement into alignment with the lateral guides 9. Such arrangements are conventional; for instance, the in-feed gripper 12 may be so constructed as to accomplish the return displacement, or suction rails or similar arrangements may be arranged upstream of the in-feed gripper 12 which accomplish the same purpose.

While the present invention is being illustrated and described as including a suction belt 8, it is to be understood that suction rails, suction rods and similar arrangements may be used for the same purpose. Also, while the drawings illustrate the use of one or two of the suction belts 8, it will be appreciated that any practically advantageous number of such arrangements can be used.

After the discussion of the various phases and the pertinent components of the apparatus, the operation of the apparatus will now be discussed in detail.

The overlapping array of sheets 1, 2, 3 reaches the operational range of the suction belt 8 which moves with a changing speed. The front end of the sheet 1 impinges upon the intercepting hook-shaped projection 11 of the respective suction belt 8, as a result of which the sheet 1 is pre-aligned. At the time of the impact of the front edge of the sheet 1 against the intercepting hook 11, the suction belt 8 has a speed which approximately corresponds to the speed of advancement of the array. Subsequently thereto, the speed of advancement of the suction belt 8 is reduced so that the sheet 1 is retarded in its advancement and is displaced, at a reduced speed, toward the front stops 5 and also in the lateral direction of the array until the lateral marginal region of the sheet 1 reaches the operational range of the pulling device 6. The stationary suction box 7 which acts on the sheet 1 from below renders the transverse or lateral displacement of the sheet 1 possible, as a result of the fact that the suction box 7 applies subatmospheric pressure to the sheet 1 upon the impingement of the sheet 1 against the intercepting hooks 11. The movement of the suction belt 8 and the pressure in the suction box 7 are controlled in a cyclical manner.

When the sheet 1 reaches with its front edge the front stops 5, the sheet 1 is aligned along its front edge. Thereafter, the pulling device 6 engages the exposed lateral marginal portion of the sheet 1 at the engaging point 15 and displaces the sheet 1 in the transverse direction until the lateral edge of the exposed lateral marginal portion of the sheet 1 abuts against side guides 9 and is aligned thereat.

In order to assure a constant abutment of the front edge of the sheet 1 against the front stops 5, separately driven brush rollers 10 act at the rear region of the sheet 1. The brush rollers 10 are adjustable to the dimensions of the particular series of sheets 1, 2, 3.

After the alignment of the sheet 1 both with the front stops 5 and with the lateral guides 9, the in-feed gripper 12 engages and advances the sheet 1 toward the printing machine and transfers the sheet 1 to the in-feed drum or roller 13. Simultaneously, as illustrated in particular in FIG. 4, the sheet 1 is displaced by a certain distance laterally, opposite to the direction of its original transverse displacement, so that the lateral marginal portion of the following sheet 2 becomes exposed for engagement by the pulling device 6 in the operating region of which such lateral marginal portion of the sheet 2 is located.

In the modification illustrated in FIG. 5, the initial lateral displacement of the sheet 1 is caused by the suction belt 8 which, in this modification, extends transversely to the direction of advancement of the array.

To achieve the lateral displacement of the respective sheet 1, there can be employed, in addition to the suction belt 8, also pneumatic means of conventional construction which act at the region of the rear edge of the sheet 1 from above.

The arrangement according to the present invention is so constructed that the lateral or transverse displacement of the sheet 2 and the lateral transverse return of the sheet 1 prior to or during its feeding into the printing machine, can be accomplished simultaneously.

The suction belts 8 are so arranged that they are able to displace the sheet 1 also to the other side of the in-feed table 4. However, the suction belts 8 which work according to this principle, have not been illustrated.

According to a variation of the method and apparatus of the present invention, which is illustrated in FIGS. 7 to 9, the sheet 1 is displaced in the same way as discussed above in connection with FIGS. *2a* and *2b* to expose the lateral marginal portion thereof, and then laterally aligned similarly to the way in which it is laterally aligned with FIG. 3. Subsequently thereto, the aligned sheet 1 is forwarded to the printing machine in a manner illustrated in FIG. 7, without being subject to any transverse return displacement opposite to the displacement during the laterally aligning operation. Even here, the initial transverse displacement of the sheet 1 out of the array is accomplished by means of the suction belt 8. The pulling device 6 which renders it possible to transversely displace or pull the sheet 1 in this variation of the embodiment of the present invention, is illustrated in FIGS. 8 and 9 in a lateral view as considered in the direction of advancement of the sheets.

FIG. 8 illustrates a pneumatic pulling rail 6.1 which acts on the sheet being aligned, here sheet 2, from below. On the other hand, FIG. 9 illustrates a mechanical pulling device 6.2 which includes a roller 6.2.1 arranged underneath the in-feed table 4, and a pulling rail 6.2.2 which is extendable toward the path of movement of the sheets of the array during the lateral aligning operation and which is capable of lifting the already aligned sheet 1. The introduction of the sheet 1 in the printing machine is achieved by means of the in-feed gripper 12.

The operation of this modified version of the present invention is as follows:

The first sheet 1 of the sheet array which advances along the in-feed table 4 in a known manner, is displaced by the suction belt 8 transversely out of the array of sheets 2, 3 and becomes automatically aligned in the direction of advancement of the array at the front stops 5. Simultaneously therewith, the lateral marginal portion of the sheet 1 reaches the operational range of the pulling device 6 so that the sheet 1 is pulled by the pulling device 6 until the lateral edge thereof abuts against the lateral guides 9 and thus is laterally aligned. After the alignment, the sheet 1 is gripped by the in-feed gripper 12, accelerated, and transferred to the in-feed drum 13 without being displaced transversely of the array of sheets opposite to the displacement thereof during the aligning operation.

The pulling device 6 is so constructed that the sheet 2 can be pulled transversely of the array without interference with the already aligned sheet 1 and the next-succeeding sheet 3.

To achieve such a non-interfering displacement, use is made of the above-mentioned pulling devices 6.1 or 6.2 which are particularly suited for this purpose.

Both the suction rail 6.1 and the mechanical pulling device 6.2 are controlled in a cyclic manner.

The roller 6.2.1 conducts a vertical movement relative to the in-feed table 4. On the other hand, the pulling rail 6.2.2 conducts a movement during its cyclical actuation, along a trajectory 18 which, for the purposes of illustration, has been exaggerated in dimensions. In accordance with the succession of the sheets 1, 2, 3 the pulling rail 6.2.2 is cyclically moved toward the path of movement of the sheets 1, 2, 3. During such cyclical movement of the pulling rail 6.2.2, the latter lifts the already aligned sheet 1 so that the lateral marginal portion of the sheet 2 to be still aligned is exposed and pressed by the roller 6.2.1 against the pulling rail 6.2.2, and pulled by the cooperation of the two toward the lateral guides 9 to be aligned thereat.

It will be understood that each of the elements described above, or two or more together, may also find a useful application in other types of constructions differing from the types described above.

While the invention has been illustrated and described as embodied in an aligning method and apparatus for use in connection with a printing machine, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An apparatus for aligning individual sheets of an elongated array of such sheets which advances longitudinally thereof over an in-feed table to a printing machine and in which each succeeding sheet partially overlaps the preceding sheet, comprising means for displacing a respective sheet of the array substantially in a plane of the latter by a distance having at least a component in a direction transverse to the elongation of the array to thereby expose a lateral marginal portion of the respective sheet; means for aligning the respective sheet at a front edge thereof; means for engaging the exposed marginal portion of the frontwardly aligned sheet and for applying thereto a force which shifts the frontwardly aligned sheet substantially in said plane by a further distance only in said direction into an aligned position of a lateral edge delimiting the exposed lateral marginal portion of the respective sheet; and means for releasing the frontwardly and laterally aligned sheet for further advancement to the printing machine, said displacing means including at least one belt arranged underneath the in-feed table and having an outer surface adapted to contact a lower major surface of the respective sheet, and means for moving said belt.

2. An apparatus as defined in claim 1, wherein said belt extends at an angle to the elongation of the array of sheets.

3. An apparatus as defined in claim 2, wherein said belt includes at least one intercepting projection extending outwardly beyond said outer surface of said belt and constituting an abutment for the front edge of the respective sheet.

4. An apparatus as defined in claim 3, wherein said intercepting projection is hook-shaped.

5. An apparatus as defined in claim 1, wherein said belt extends in said direction.

6. An apparatus as defined in claim 1, wherein said belt includes a plurality of perforations; and further comprising means for applying a partial vacuum to the interface between the outer surface of the belt and the lower major surface of the respective sheet through said perforations.

7. Apparatus for aligning individual sheets of an elongated array of such sheets which advances longitudinally thereof to a printing machine and in which each succeeding sheet partially overlaps the preceding sheet, comprising means displacing a respective sheet of the array substantially in a plane of the latter by a distance having at least a component in a direction transverse to the elongation of the array to thereby expose a lateral marginal portion of the respective sheet; means aligning the respective sheet at a front edge thereof; means engaging the exposed lateral marginal portion of the frontwardly aligned sheet and applying thereto a force which shifts the frontwardly aligned sheet substantially in said plane by a further distance only in said direction into an aligned position of a lateral edge delimiting the exposed lateral marginal portion of the respective sheet; means releasing the frontwardly and laterally aligned sheet for further advancement to the printing machine; and means operative subsequent to the releasing for advancing the frontwardly and laterally aligned sheet to the printing machine.

8. An apparatus as defined in claim 7, wherein said aligning means includes at least two front stops; and further comprising at least two lateral guides against which the lateral edge of the exposed lateral marginal portion of the respective sheet abuts in said aligned position thereof.

9. An apparatus as defined in claim 7, wherein said engaging means includes a pulling device arranged laterally of the in-feed table as considered in said direction.

10. An apparatus as defined in claim 9, wherein said pulling device includes a pneumatic suction rail, and means for reciprocating said rail in and opposite to said direction.

11. An apparatus as defined in claim 9, wherein said pulling device includes a roller and a pulling rail which mechanically cooperate with one another to pull the respective sheet in said direction.

12. The apparatus defined in claim 7, the sheet advancement subsequent to the releasing being performed with the sheet travelling exclusively in a path such that the lateral edge of the exposed lateral marginal portion of the sheet travels in an extension of the aligned position thereof.

13. The apparatus defined in claim 7, wherein said displacing means at least begins to perform the displacing prior to completion of the aligning of the front edge of the sheet.

14. The apparatus defined in claim 7, wherein said displacing means begins to perform the displacing subsequent to completion of the aligning of the front edge of the sheet.

15. The apparatus defined in claim 7, wherein said displacing means at least begins to perform the displacing prior to completion of the aligning of the front edge of the sheet.

16. The apparatus defined in claim 7, wherein said displacing means begins to perform the displacing subsequent to completion of the aligning of the front edge of the sheet.

17. A method of aligning individual sheets of an elongated array of such sheets which advances longitudinally thereof to a printing machine and in which each succeeding sheet partially overlaps the preceding sheet, comprising the steps of displacing a respective sheet of the array substantially in a plane of the latter by a distance having at least a component in a direction transverse to the elongation of the array to thereby expose a lateral marginal portion of the respective sheet; aligning the respective sheet at a front edge thereof; engaging the exposed lateral marginal portion of the frontwardly aligned sheet and applying thereto a force which shifts the frontwardly aligned sheet substantially in said plane by a further distance only in said direction into an aligned position of a lateral edge delimiting the exposed lateral marginal portion of the respective sheet; releasing the frontwardly and laterally aligned sheet for further advancement to the printing machine; and subsequent to the releasing step advancing the frontwardly and laterally aligned sheet to the printing machine.

18. A method as defined in claim 17, the last-mentioned step being performed with the sheet travelling exlusively in a path such that the lateral edge of the exposed lateral marginal portion of the sheet travels in an extension of the aligned position thereof.

19. A method as defined in claim 17, wherein said displacing step at least begins prior to completion of the aligning of the front edge of the sheet.

20. A method as defined in claim 17, wherein said displacing step begins subsequent to completion of the aligning of the front edge of the sheet.

21. A method as defined in claim 17, wherein said displacing step at least begins prior to completion of the aligning of the front edge of the sheet.

22. A method as defined in claim 17, wherein said displacing step begins subsequent to completion of the aligning of the front edge of the sheet.

23. An apparatus for aligning individual sheets of an elongated array of such sheets which advances longitudinally thereof over an in-feed table to a printing machine and in which each succeeding sheet partially overlaps the preceding sheet, comprising means for displacing a respective sheet of the array substantially in a plane of the latter by a distance having at least a component in a direction transverse to the elongation of the array to thereby expose a lateral marginal portion of the respective sheet; means for aligning the respective sheet at a front edge thereof; means for engaging the exposed marginal portion of the frontwardly aligned sheet and for applying thereto a force which shifts the frontwardly aligned sheet substantially in said plane by a further distance only in said direction into an aligned position of a lateral edge delimiting the exposed lateral marginal portion of the respective sheet; means for releasing the frontwardly and laterally aligned sheet for further advancement to the printing machine; and further comprising separately adjustable brushes contacting an upper major surface of the respective sheet.

* * * * *